US011535983B2

(12) United States Patent
Shagaev

(10) Patent No.: US 11,535,983 B2
(45) Date of Patent: Dec. 27, 2022

(54) METHOD FOR PRODUCING A FIBROUS MATERIAL

(71) Applicant: Andritz AG, Graz (AT)

(72) Inventor: Oleg Shagaev, Vienna (AT)

(73) Assignee: ANDRITZ AG, Graz (AT)

( * ) Notice: Subject to any disclaimer, the term of this patent is extended or adjusted under 35 U.S.C. 154(b) by 1045 days.

(21) Appl. No.: 16/307,823

(22) PCT Filed: May 18, 2017

(86) PCT No.: PCT/EP2017/061926
§ 371 (c)(1),
(2) Date: Aug. 14, 2019

(87) PCT Pub. No.: WO2017/215877
PCT Pub. Date: Dec. 21, 2017

(65) Prior Publication Data

US 2019/0352849 A1 Nov. 21, 2019

(30) Foreign Application Priority Data

Jun. 17, 2016 (AT) ..... A 50551/2016

(51) Int. Cl.
*D21C 3/12* (2006.01)
*D21B 1/02* (2006.01)
(Continued)

(52) U.S. Cl.
CPC ..... *D21B 1/021* (2013.01); *D21B 1/14* (2013.01); *D21C 3/12* (2013.01); *D21D 1/20* (2013.01)

(58) Field of Classification Search
USPC ..... 162/28, 83
See application file for complete search history.

(56) References Cited

U.S. PATENT DOCUMENTS 3,225,028 A * 12/1965 Nordgren ..... D21H 17/32 162/178
4,486,267 A * 12/1984 Prusas ..... D21C 3/12 162/28
(Continued)

FOREIGN PATENT DOCUMENTS

CA 1051618 4/1979
CA 1226705 9/1987
(Continued)

OTHER PUBLICATIONS

Search Report.
International Preliminary Report on Patentability dated May 24, 2018 for International Patent Application No. PCT/EP2017/061926.

*Primary Examiner* — Jacob T Minskey
(74) *Attorney, Agent, or Firm* — Alix, Yale & Ristas, LLP

(57) ABSTRACT

A method for producing a fibrous material from lignocellulose from wood, preferably in the form of wood chips. The lignocellulose material is impregnated with a mixture of sodium sulfite and sodium bisulfite and subsequently undergoes a comminution process in a refiner. Additional chemicals from a mixture of sodium sulfite and sodium bisulfite are directly introduced into the refiner, allowing optimal conditions to be set for both additive flows of chemicals such that the process can be operated in an energetically advantageous manner and corrosion and scale formation in the refiner and subsequent aggregates can be prevented as much as possible.

20 Claims, 1 Drawing Sheet

(51) Int. Cl.
*D21B 1/14* (2006.01)
*D21D 1/20* (2006.01)

(56) References Cited

U.S. PATENT DOCUMENTS

| | | | |
|---|---|---|---|
| 8,734,611 | B2 | 5/2014 | Sabourin et al. |
| 2018/0243939 | A1 | 8/2018 | Seifert et al. |

FOREIGN PATENT DOCUMENTS

| | | | |
|---|---|---|---|
| EP | 0199481 | | 10/1986 |
| EP | 2103734 | | 9/2009 |
| EP | 2348154 | | 7/2011 |
| GB | 1041995 | * | 9/1966 |
| WO | WO2007/012350 | | 2/2007 |
| WO | WO2011/063800 | | 6/2011 |

* cited by examiner

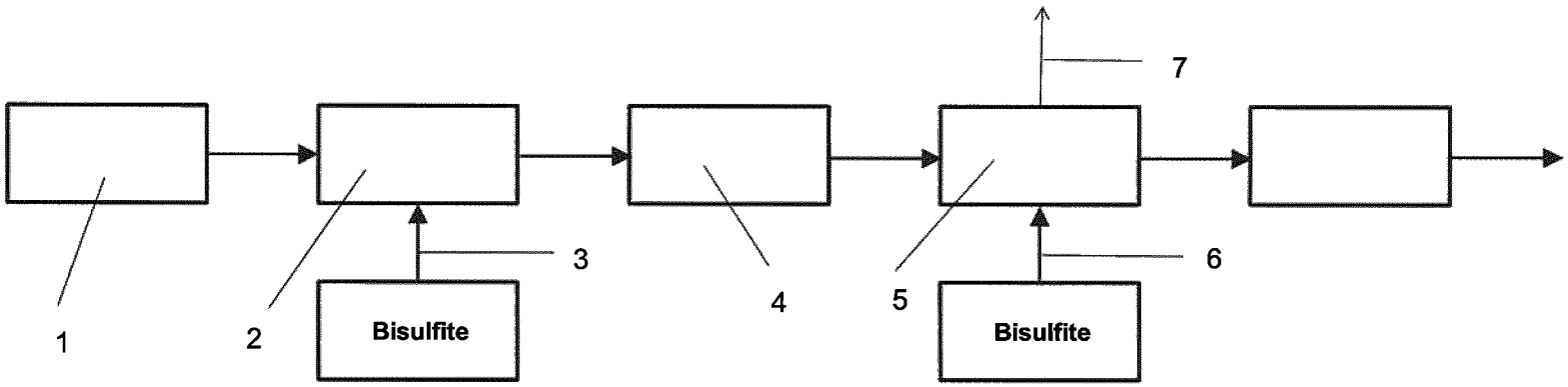
1
2
Bisulfite
3
4
5
Bisulfite
6
7

METHOD FOR PRODUCING A FIBROUS MATERIAL

BACKGROUND

The invention relates to a method for producing pulp from lignocellulose made from wood, preferably in the form of wood chips, where the lignocellulose material is impregnated with chemicals from a mixture of sodium sulphite and sodium bisulphite and then subjected to a grinding process in a refiner.

Methods from the production of high-yield pulp are known, for example from CA 1051618. In this case, chemicals are added to chemical pulp, mechanical pulp, chemi-mechanical pulp, thermo-mechanical pulp, etc., for impregnating in a pre-treatment stage in order to remove the lignin.

WO2007/012350 A1 describes a method for manufacturing articles made of wood material, where the wood is treated with bisulphite, e.g. in the digester or refiner, before being glued together EP 0199481 A1 describes a method for producing chemical pulp, where chemicals from the sodium sulphites group, among others, are used for impregnation. Using sulphur compounds for wood chips and also for annual plants is well known and used in order to save energy during grinding and to improve the quality of mechanical pulp. The chemicals used here are mainly mixtures of sodium sulphite and sodium bisulphite at temperatures of 100-150° C., where the pulp is left in a tank for a certain dwell time after being impregnated with the chemicals. Sodium sulphite and sodium bisulphite are both present, however the balance changes depending on the pH value. For example, at a low pH (approx. 4-5.5), there is more sodium bisulphite, while at higher pH values (approx. 6-7.5), the mixture contains more sodium bisulphite. In order to prevent $SO_2$ emissions, operations usually take place at a pH of less than 5.5, frequently also less than 4.0. The gaseous $SO_2$ as the product of bisulphite decomposition can occur in the pre-treatment stage but also during grinding. Free $SO_2$ can also condense with steam and cause corrosion at colder parts of the apparatus. However, under conditions with higher pH values, a coating forms on the refiner plates that greatly reduces their service life. It can also block the channels in the refiner plates with calcium salts. Corrosion can occur at lower pH values, and there may also be $SO_2$ emissions in and after the refiner.

SUMMARY

The disclosed embodiments assist in avoiding corrosion on the one hand and coating on the refiner plates on the other hand.

This is achieved by feeding chemicals from a mixture of sodium sulphite and sodium bisulphite directly into the refiner in addition, where the chemicals are fed to the impregnation stage with a pH of 6.0-7.5, preferably 6.5-7.0, and the additional chemicals are added to the refiner with a pH of 4.0-5.5, preferably 4.2-4.5. This can be used to create different adding conditions for impregnation purposes and to the refiner, and in particular, the pH values can be adjusted to the optimum to avoid corrosion and coating. By doing so, corrosion can be avoided in the main apparatuses by means of SO2 condensed with steam and it becomes possible to greatly reduce or prevent coating on the refiner plates and thus substantially extend the service life of the plates, which results in enormous cost savings. In addition, the formation of salts, particularly calcium salts, is largely avoided.

In one embodiment, 60-80% of the chemicals are added during impregnation and 20-40% are added in the refiner. This ensures that the chemicals are utilized particularly well.

In disclosed embodiments, impregnation takes place at a temperature of 80-170° C., preferably at 130-140° C. The chemicals can take effect particularly well and fast in this temperature range.

In disclosed embodiments, the total quantity of chemicals added amounts to 1-20 kg/t, preferably 10-15 kg/t. As a result, the specific energy consumption of the process, especially grinding in the refiner, can be reduced significantly.

BRIEF DESCRIPTION OF THE DRAWING

The invention will now be described in examples and referring to drawings, where the figure contains a flow chart of a pre-treatment plant with impregnation and subsequent grinding in the refiner.

The FIGURE shows an example of a plant arrangement according to the invention.

DETAILED DESCRIPTION

Wood chips, which can be pre-treated if necessary, are taken from a storage bin 1 and fed to a reactor 2 for impregnation. A chemical is added through a pipe 3 at the beginning of this reactor. This chemical is a mixture of sodium sulphite and sodium bisulphite. The chemical added here has a pH of approximately 6.5-7.5 and amounts to some 60-80% of the total chemicals added. It has been shown that 60-80% of the reaction is already complete after a short time, often only a few seconds of reaction time, at a pH of 6.5-7.0. As a basic principle, the pH can be between 6.0 and 7.5. The impregnated chips are fed on a conveyor 4, for example a screw conveyor, to a refiner 5 for grinding. At the same time, the remaining quantity of chemicals, amounting to approximately 20-40% and again being a mixture of sodium sulphite and sodium bisulphite, is fed through a pipe 6. Besides the chemicals being added directly in the grinding zone of the refiner 5, chemicals can also be fed into the grinding zone together with the dilution water through holes in the stator refiner plates. Here, too, it is a mixture of sodium sulphite and sodium bisulphite, preferably with a pH of 4.0-4.5. As a basic principle, the pH here can be between 4.0 and 5.5. This results in a pH in the refining zone that prevents deposits and coating on the refiner plates, especially calcium sulphite coating. If gaseous $SO_2$ forms in the refining zone, this would be carried off with the recycled steam 7 and then absorbed or neutralized by lignocellulose material with a higher pH. The steam 7 can be fed to a plug screw feeder after the storage bin 1 in order to heat the chips. Additional steam is normally fed to a heat recovery plant. As addition of the chemicals, particularly the bisulphite, is split up, the pH can be adjusted optimally to the given needs. In this way, a low pH in the grinding process can keep the specific energy consumption down while securing the strength and optical properties of the pulp and at the same time avoiding corrosion and coating in the refiner and subsequent apparatus.

The invention is not limited to the examples as described. In fact, it can be applied both to hardwood and softwood.

The invention claimed is:

1. A method for producing pulp from a lignocellulose material made from wood in a manner that avoids or reduces corrosion and coating in a refiner, where the lignocellulose material is impregnated with chemicals from a mixture of sodium sulfite and sodium bisulfite in a reactor and subsequently grinded in the refiner, comprising:

feeding chemicals to the reactor during impregnation of the lignocellulose material; and feeding chemicals directly to the refiner, wherein the chemicals comprise a mixture of sodium sulfite and sodium bisulfite, the chemicals fed to the reactor during impregnation have a pH within a range of 6.0-7.5, and the chemicals fed to the refiner have a pH within a range of 4.0-5.5 and that is sufficient to avoid or reduce corrosion and coating in the refiner.

2. The method according to claim 1, wherein the chemicals fed to the refiner have a pH within the range of 4.2-4.5.

3. The method according to claim 2, wherein chemicals fed to the reactor during impregnation have a pH within the range of 6.5-7.0.

4. The method according to claim 1, wherein chemicals fed to the reactor during impregnation have a pH within the range of 6.5-7.0.

5. The method according to claim 1, wherein the lignocellulose material is in the form of wood chips.

6. The method according to claim 1, wherein the chemicals fed to the reactor during impregnation and the chemicals fed to the refiner combine to 100%, characterized in that 60-80% of said 100% are added to the reactor during impregnation.

7. The method according to claim 6, characterized in that impregnation takes place at a temperature within a range of 80-170° C.

8. The method according to claim 7, characterized in that impregnation takes place at a temperature within the range of 120-140° C.

9. The method according to claim 1, characterized in that impregnation takes place at a temperature within a range of 80-170° C.

10. The method according to claim 9, characterized in that impregnation takes place at a temperature within a range of 120-140° C.

11. The method according to claim 1, characterized in that the total quantity of chemicals added amounts to 1-20 kg of chemicals per ton of wood.

12. The method according to claim 1, characterized in that the total quantity of chemicals added amounts to 10-15 kg of chemicals per ton of wood.

13. A method of producing pulp from a lignocellulose material made from wood, where the lignocellulose material is impregnated with chemicals from a mixture of sodium sulfite and sodium bisulfite in a reactor and subsequently grinded in a refiner, comprising:

feeding a wood material to a reactor for impregnation and adding chemicals comprising sodium sulfite and sodium bisulfite having a pH adjusted to reduce or prevent corrosion and coating in the refiner and within a range of 6.0-7.5 to the reactor during impregnation to yield impregnated wood material;

transferring the impregnated wood material from the reactor to a refiner and adding chemicals comprising sodium sulfite and sodium bisulfite having a pH adjusted to reduce or prevent corrosion and coating in the refiner and within a range of 4.0-5.5 directly to the refiner, wherein impregnation in the reactor occurs at a temperature within a range of 80-170° C.

14. The method according to claim 13, wherein the chemicals fed to the refiner have a pH within the range of 4.2-4.5.

15. The method according to claim 13, wherein chemicals fed to the reactor during impregnation have a pH within the range of 6.5-7.0.

16. A method of producing pulp from a lignocellulose material made from wood in a manner that avoids or prevents corrosion and coating in refiner plates of a refiner, where the lignocellulose material is impregnated with chemicals from a mixture of sodium sulfite and sodium bisulfite in a reactor and subsequently grinded in a refiner, comprising:

providing chemicals comprising a mixture of sodium sulfite and sodium bisulfite;

feeding a wood material to a reactor for impregnation and adding 60-80% of the chemicals at a pH within a range of 6.0-7.5 to the reactor during impregnation to yield impregnated wood material; and transferring the impregnated wood material from the reactor to the refiner and adding the rest of the chemicals at a pH within a range of 4.0-5.5 directly to the refiner at a grinding zone, wherein the impregnation in the reactor occurs at a temperature within a range of 80-170° C., wherein the chemicals added during impregnation amount to 60-80% of the chemicals used in the reactor and the refiner, and wherein the chemicals added to the refiner amount to 20-40% of the chemicals used in the reactor and the refiner.

17. The method according to claim 16, wherein the chemicals fed to the refiner have a pH within the range of 4.2-4.5.

18. The method according to claim 16, wherein chemicals fed to the reactor during impregnation have a pH within the range of 6.5-7.0.

19. The method according to claim 1, wherein the ranges of pH are sufficient to prevent or avoid deposits and coating of calcium sulfite on refiner plates of the refiner and any gaseous sulfer dioxide formed in a refiner zone of the refiner is condensed with steam.

20. The method according to claim 13, wherein the ranges of pH are sufficient to prevent or avoid deposits and coating of calcium sulfite on refiner plates of the refiner and any gaseous sulfer dioxide formed in a refiner zone of the refiner is condensed with steam.

* * * * *